United States Patent [19]

Lück et al.

[11] 4,293,265

[45] Oct. 6, 1981

[54] HYDRAULICALLY OPERATED HOISTING APPARATUS FOR A SHIP FOR PICKING FLOATING OBJECTS UP OUT OF THE SEA

[75] Inventors: Klaus Lück, Wenningsen; Fritz-Otto Poeppel, Wunstorf, both of Fed. Rep. of Germany

[73] Assignee: Preussag Aktiengesellschaft, Hanover, Fed. Rep. of Germany

[21] Appl. No.: 940,745

[22] Filed: Sep. 8, 1978

[30] Foreign Application Priority Data

Sep. 9, 1977 [DE] Fed. Rep. of Germany ..... 2740608

[51] Int. Cl.[3] ..... B63B 27/10

[52] U.S. Cl. ..... 414/140; 212/190; 414/730; 414/734; 414/735; 414/569

[58] Field of Search ..... 414/138, 139, 143, 729, 414/730, 732, 734, 735, 569; 114/261, 263, 258; 9/39; 212/190

[56] References Cited

U.S. PATENT DOCUMENTS

| | | | |
|---|---|---|---|
| 3,401,804 | 9/1968 | Link | 414/140 X |
| 3,503,528 | 3/1970 | Martelee | 414/754 |
| 3,631,989 | 1/1972 | McCormick | 414/734 |
| 3,671,986 | 6/1972 | Peters | 9/39 |
| 4,021,019 | 5/1977 | Sanders | 212/3 X |

*Primary Examiner*—Frank E. Werner

*Attorney, Agent, or Firm*—Allegretti, Newitt, Witcoff & McAndrews

[57] ABSTRACT

A hoisting apparatus mounted on the deck of a ship for picking floating objects from the sea having an articulated lifting arm which extends over the side of the ship and gripping device suspended from the end of the arm for grasping objects in the water. The arm is actuated by an hydraulic cylinder connected to a source of high pressure liquid which may be dumped into the cylinder instantaneously in response to the closing of the gripping device around the object. The liquid is pressurized by a compressed gas. The apparatus produces a high hoisting speed and lifts the object very quickly from the water.

6 Claims, 1 Drawing Figure

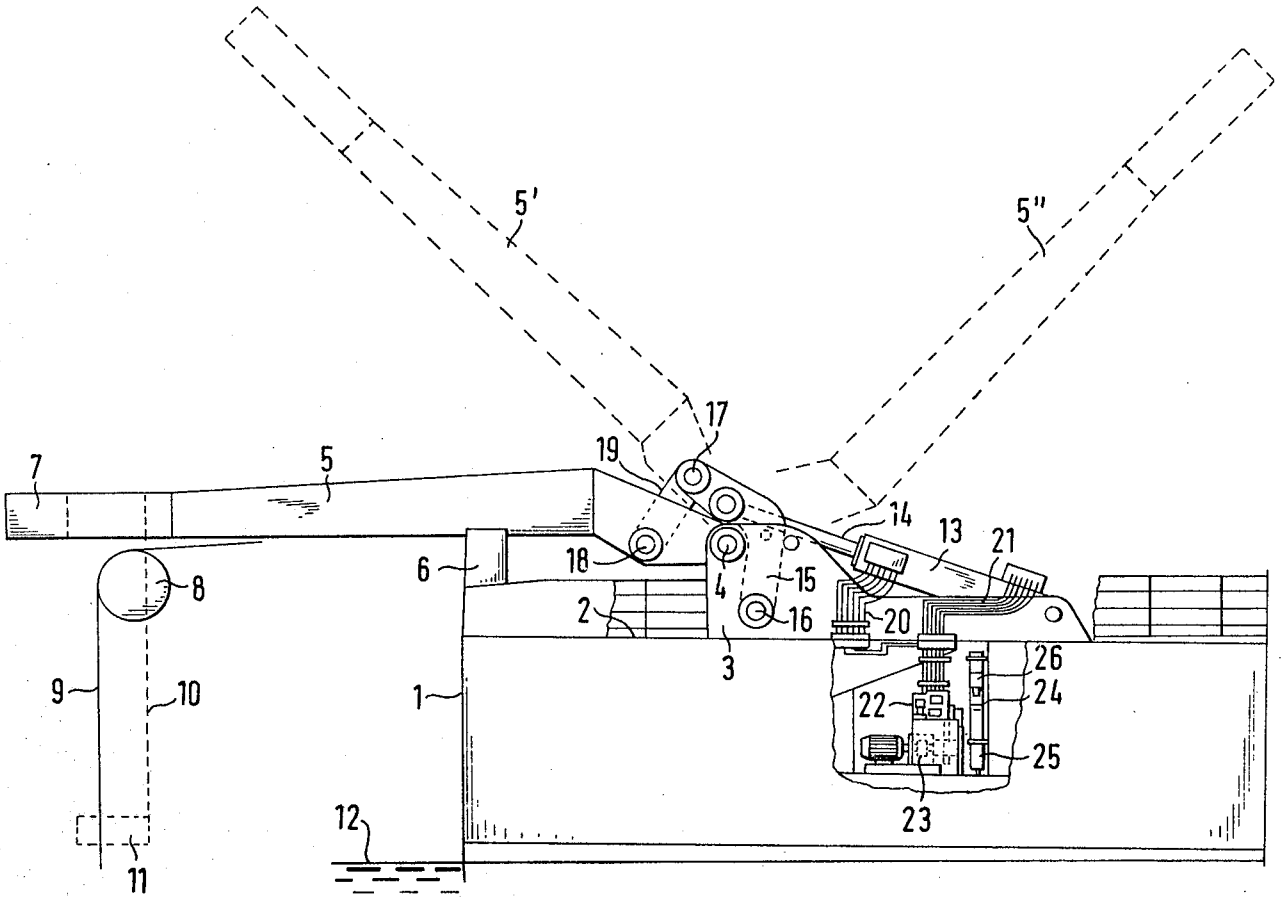
5''
5'
5
7
8
9
10
11
12
6
1
2
3
4
17
19
18
15
16
14
13
21
20
22
23
26
24
25

HYDRAULICALLY OPERATED HOISTING APPARATUS FOR A SHIP FOR PICKING FLOATING OBJECTS UP OUT OF THE SEA

BACKGROUND OF THE INVENTION

The invention relates to a hydraulically operated hoisting apparatus for a ship for picking floating objects up out of the sea.

It is known to pick up floating objects from a ship using a crane having a boom which projects over the side of the ship, while a cable connected to a winch and to the object which is to be picked up is suspended from the upwardly inclined boom. When the winch is operated, the cable is drawn up and the object is hoisted out of the water.

With a slow hoisting speed, there is a danger, particularly if the sea is fairly rough, that the movements of the ship which are transmitted to the crane will cause the suspended object to strike the ship or the surface of the water once or repeatedly, which can result in damage to or destruction of the object.

In order to prevent the object or equipment which is being picked up from colliding with the ship or crane, the hoisting speed must be greater than the sum of the velocities resulting from the pitch and roll of the ship, on the one hand, and the orbital speed of the sea swell, on the other hand. In unfavourable cases, all these velocities may be added together and in certain circumstances may reach a speed of several meters per second.

A considerable drive power is necessary in order to attain such a high hoisting speed. Known heavy duty hoisting equipment will not produce the hoisting speeds needed. Moreover, more powerful drives of this kind also require energy supplies greater than those usually available on board ship.

With a crane, there is also the disadvantage that the freely suspended cable may swing sideways over a large part of the hoisting distance. Pendulum movements of this kind may cause impact against the side of the ship and result in damage to or destruction of the object or equipment which is being picked up.

THE INVENTION

The object of the invention is to provide a hydraulically operated hoisting apparatus for a ship for picking floating objects out of the sea, wherein the object to be picked up is prevented from striking the surface of the water and from swinging and hitting the side of the ship.

The problem is solved by an arm fixed on the deck of a ship pivotable about a horizontal axis, the end of said arm projecting freely over the side of the ship and comprising means for picking up objects, the arm being coupled to a hydraulic cylinder connected to a source of liquid, the said source of liquid comprising a liquid store which is acted on by gas pressure and connected to the hydraulic cylinder through a valve which is opened by a sensing member responsive to the presence of an object within a gripping means at the end of the arm.

The solution according to the invention is based on the concept of picking the object up out of the sea basically by a gripping means rigidly connected to the lifting arm, which unlike a cable, prevents any lateral swinging movements. In order to prevent the object gripped from colliding with the surface of the sea, which is not basically prevented by the downwardly-extending rigid arm, the invention provides for the object to be hoisted suddenly at the moment it is gripped by the arm at the very end of the gripping means. After the valve which activates the hoisting process has been actuated, the object is raised suddenly and rapidly, but at the same time elastically and thus carefully by means of the supply of energy from the liquid store which is acted on by compressed air, with the result that the object is rapidly lifted clear of the danger area, above the surface of the water. This danger area may extend up to a height of 10 to 12 meters, for example, while the hoisting time is preferably 4 seconds or less. The power required for this is so great that it cannot be supplied by the electricity supply of a ship. According to the invention, the peak power demands are supplied by the store of pressurized liquid. The overall drive power can be kept correspondingly small.

Appropriately, a gripping device for gripping the object to be picked up out of the sea is provided at the end of the lifting arm. Additionally, a cable is used which is connected to a winch and by means of which the object to be picked up is drawn into the gripping device and thus fixedly connected to the end of the arm. As soon as the object to be picked up is firmly held by the gripping device, sensing means responsive to the presence of the object causes the valve to the hydraulic cylinder to open. Consequently, the lifting arm together with the object are not raised until the object has moved right inside the gripping device. If this is not the case, the object will not be raised from the surface of the water and therefore no swinging movements or impact against the side of the ship can occur.

In its lowest position, in which the arm grips the object to be picked up, the arm appropriately extends substantially horizontally and is thus relatively close to the surface of the water. An arm of this construction is relatively restricted in length. In order to enable the object which is to be picked up to be moved well in from the edge of the deck, a further feature of the invention provides that the lifting arm be pivotable backwards over its horizontal pivot axis, and the object picked up can then be set down at this point.

Since power is no longer being used but is being released as the lifting arm pivots away over its dead center, according to a further feature of this embodiment a throttle valve is provided in the supply line to the hydraulic cylinder; after the arm has pivoted away over its pivot axis or its dead center, this valve restricts fluid flow and thus automatically controls lowering of the arm.

Of course, during the discharging of the energy store, there may also be an additional pump in operation, so that the energy store can be made somewhat smaller.

DETAILED DESCRIPTION

Other advantages and details of the invention will become apparent from the following description of an embodiment by way of example.

The drawing consists of a side elevational view of the apparatus and shows the stern 1 of a ship, with a stand 3 fixed to the deck 2, while a pivot axis 4 for a lifting arm 5 is clamped in the said stand, the said arm abutting on a support 6 in the lowest position shown by solid lines and extending with its free end 7 over the stern 1.

At the free end 7 of the arm 5 there is a roller 8 over which a cable 9 runs to a winch (not shown) mounted on the deck 2. Rigidly connected to the free end 7 of the arm 5 there is also a gripping device, which is shown only diagrammatically by dotted lines 10, and includes a lower part 11 that defines a sensing device (shown schematically as item 11 in FIG. 1) for responding in a predetermined way to the presence of an object within the gripping means 10. The cable 9 runs down the lower part 11 which extends downwards roughly to a point just above the surface 12 of the sea, which is shown diagrammatically.

The upwards movement of the lifting arm 5 through an intermediate position 5' of the arm, shown by broken lines, to a rear resting position 5'' is performed by means of a hydraulic cylinder 13 which is hingedly connected to the stand 3 and has a piston rod 14 connected to a bell crank lever 15 the rotation axis 16 of which is located approximately below the pivot axis 4 of the arm 5 and the end of which is connected to the arm 5 via pivot joints 17 and 18 and a connecting link 19.

The hydraulic cylinder 13 is connected to a control unit 22 via hydraulic lines 20 and 21, the said control unit 22 also being connected to a pump 23 and a liquid store 24 which is acted on by gas pressure. Accumulators 25 are located in the lower part of the liquid store 24, while a pressurized gas cushion 26 is located in the upper part.

When the hoisting apparatus according to the invention is used, first of all the end of the cable 9 is connected to the object to be picked up which is floating in the water and the cable is hauled in using the winch (not shown) until the object to be picked up enters the lower part 11 of the gripping device 10. After the object has been properly gripped by the gripping device 10, a member, such as sensing arm 11, senses the presence of the object and, in response to that presence, activates the control unit 22 in which there is a valve which opens the line 20 from the liquid store 24 to the hydraulic cylinder 13. As a result, the piston rod 14 is pulled in, the bell crank lever 15 is moved to the right and the arm 5 is moved upwards by the connecting rod 19. This movement takes place very rapidly, owing to the high energy stored in the pressurized liquid, and is also carried out carefully and elastically, so that the object picked up moves very quickly away from the surface of the water and the danger of damage is eliminated.

After the arm has reached the position 5', there is no further appreciable danger, the liquid store 24 has been substantially discharged; the remaining backwards pivoting movement takes place slowly, e.g. with only the pump 23 providing pressure to the liquid. When the arm 5 passes its top dead center, further energy input is not necessary, since gravity pulls the arm downwardly. At dead center, a throttle valve becomes effective which causes the arm 5 to be lowered slowly backwards into the position 5''. In this position, the object picked up is removed and set down on the deck 2.

What is claimed is:

1. In a hydraulically-operated hoisting apparatus on a ship for picking floating objects from the sea, including a lifting arm mounted on the ship and having means articulated at its inner end to pivot about a horizontal axis, the outer end of said arm projecting freely over the side of the ship, gripping means for firmly holding said objects, said gripping means being connected to said outer end of and suspended from said lifting arm and including a member having a first end and a second end, said first end being connected to said object to be picked up and said second end being connected to means for drawing said object into said gripping means, a hydraulic cylinder connected to said lifting arm near said inner end to raise said arm upwardly about said horizontal axis, a body of liquid in a storage container, control means connecting and controlling the flow of said liquid to said hydraulic cylinder, said control means including a valve for controlling liquid flow to the cylinder, and presence sensing means for activating said control means in response to the presence of an object within said gripping means to cause said valve to open, thereby supplying said liquid to the cylinder to raise said lifting arm, the improvement comprising, in combination:

low energy drive power means for pressurizing said body of liquid to drive said hydraulic cylinder rapidly initially and raise said lifting arm quickly thereby hoisting said object suddenly and securely from the surface of the sea at the moment said object is gripped by said gripping means, said low energy drive power means including low energy pump means for compressing air, said body of said liquid being acted upon by said compressed air to provide a source of highly pressurized liquid.

2. The apparatus of claim 1 in which said lifting arm in its lowest position is substantially horizontal.

3. The apparatus of claim 1 in which said lifting arm is adapted to swing past dead center over said horizontal axis.

4. The apparatus of claim 3 in which said connecting means also includes a throttle valve which is actuated when the lifting arm swings past dead center.

5. The apparatus of claim 1 in which the low energy drive means further includes a a low energy liquid pump to provide pressure to the liquid after the pressurized liquid has been discharged from said storage container.

6. The apparatus of claim 1 in which the articulating means for pivoting the lifting arm includes a bell crank having one end mounted below the pivot axis of the arm and the other end connecting to the lifting arm through a pivoted link, with an end of a connecting rod of said hydraulic cylinder being pivoted to said crank intermediate said ends.

* * * * *